United States Patent [19]

Minvielle et al.

[11] Patent Number: 4,474,505

[45] Date of Patent: Oct. 2, 1984

[54] DRAINING, IRRIGATING AND DISPERSING MASS

[76] Inventors: Monique L. S. Minvielle, 11, rue Solferino, 75007 Paris; Albert H. F. Mazoin, Chateau de la Fleunie, 24570 Condat sur Vezere; Robert P. Brun, Villa Piat, Avenue de la Croix du Sud, 33120 Arcachon; Sylvain V. L. Chevanne, Moulin du Village, 95450 Themericourt, Val d'Oise; Jacques L. A. See, 78 Boulevard Victor Hugo, 92200 Neuilly-sur-Seine, Hauts de Seine, all of France

[21] Appl. No.: 490,181

[22] Filed: Apr. 29, 1983

Related U.S. Application Data

[63] Continuation-in-part of Ser. No. 169,711, Jul. 17, 1980, Pat. No. 4,411,555.

[30] Foreign Application Priority Data

| | | | |
|---|---|---|---|
| Jul. 17, 1979 | [FR] | France | 79 18429 |
| Dec. 11, 1979 | [FR] | France | 79 30298 |
| Jul. 3, 1980 | [FR] | France | 80 14849 |

[51] Int. Cl.[3] ..... E02B 11/00

[52] U.S. Cl. ..... 405/50; 405/36

[58] Field of Search ..... 405/36–51; 52/169.5, 169.14; 47/48.5, DIG. 4

[56] References Cited

U.S. PATENT DOCUMENTS

| | | | |
|---|---|---|---|
| 968,225 | 8/1910 | Ziller | 405/45 |
| 2,145,934 | 2/1939 | Kingman | 47/48.5 X |
| 2,183,657 | 12/1939 | Page | 405/50 X |
| 2,639,909 | 5/1953 | Lera | 405/50 X |
| 2,834,466 | 5/1958 | Hament | 405/50 X |
| 3,167,600 | 1/1965 | Worman | 405/50 X |
| 3,233,414 | 2/1966 | Hansen et al. | 405/50 |
| 3,438,206 | 4/1969 | Stark | 405/50 |
| 3,685,298 | 8/1972 | Takanashi | 405/36 |
| 3,797,250 | 3/1974 | Canerari | 405/45 |

FOREIGN PATENT DOCUMENTS

| | | | |
|---|---|---|---|
| 431309 | 7/1935 | United Kingdom | 405/36 |

*Primary Examiner*—Dennis L. Taylor

*Attorney, Agent, or Firm*—Kirschstein, Kirschstein, Ottinger & Israel

[57] ABSTRACT

A method and mass for the drainage, irrigation and lightening of soils is constituted by hollow elements dispersed in soil so as to define capillary or semi-capillary passages. The elements are bulked up so that they can rest in an irregular fashion one relative to the others by providing in between them spaces of variable shapes and dimensions thereby to supply drainage, irrigation, lightening and enrichment of soils.

12 Claims, 14 Drawing Figures

DRAINING, IRRIGATING AND DISPERSING MASS

CROSS-REFERENCE TO RELATED APPLICATION

This application is a continuation-in-part of application Ser. No. 169,711 filed July 17, 1980 for A DRAINING, IRRIGATING AND DISPERSING MASS, now U.S. Pat. No. 4,411,555.

BACKGROUND OF THE INVENTION

The present invention relates to the drainage of soils by means of a porous mass which can also be used for irrigation purposes.

In fact, due to its construction, the mass of the invention allows maintaining the soil in which it is buried in a state of great permeability and, since this mass may be placed according to any disposition, the drainage or irrigation and lightening functions may be carried out without difficulty. The mass of the invention exhibits the feature of being very difficult to clog up and therefore it can keep its properties for a very long time when dispersed in the soil.

A further advantage of the mass of the invention resides in the fact that its constituent elements allow making connections and deviations in all directions and eventually with other drainage devices when they are placed in a trench.

The draining mass of the invention remedies also the problem well known of the specialists who use perforated drainage tubes in the holes of which the roots make their way and tend to proliferate by forming what they call "foxtails".

Where, on the contrary, the mass of the invention is used for irrigation purposes, notably for cultivations on slabs, it forms a kind of soft underground litter which can be fed with water through ducts emerging from the slab. The compressibility of the mass is such that the water has a tendency to be distributed and to re-ascend by capillarity under the effect of the earth pressure. The mass causes also an air circulation, notably if ventilation holes are provided in the support slab, which is very favorable for the life of the crops.

On the other hand, when the constituent elements of the mass are dispersed within the earth on the occasion of a deep ploughing, they contribute to a lightening of the density of the ground by forming, after the manner of "tunnels" dug by earthworms, multiple ventilation, circulation and irrigation ducts which favor the crops and the distribution of the fertilizers.

In this respect, said elements may be advantageously charged with fertilizers when being dispersed in the ground, thereby becoming a progressive carrier for these products.

A first object of the invention is therefore to drain soil by means of a porous mass which also can be used for irrigation purposes. A kind of soft underground litter which is compressible is provided so that the water is distributed and redispersed by cappilarity. Furthermore, this mass of elements, when dispersed in the earth, contributes to a lightening of the density of the soil.

A second object of the invention is that the mass is formed of hollow elements which individually define capillary or semi-capillary passages. In other words, each individual element has a through open-ended passage which is of capillary or semi-capillary dimensions.

In this respect, the adjectives "capillary" or "semi-capillary" define the dimensions of a passage which distinguish basically from the art. "Capillary" means "resembling a hair". The word "capillary" is derived from the Latin "capillus" which means "hair". In other words, a capillary or even a semi-capillary passage is one of very small diameter and refers in the present instance to a passageway the diameter of which is small enough to overcome surface tension to a substantial degree. The familiar example of a capillary tube is a tube whose diameter is so small that when placed in water, water will significantly rise in the tube due to capillary action which overcomes the surface tension of the main body of water. Webster's Unabridged Dictionary, among its definitions of "capillary", mentions one wherein the diameter of the capillary dimension is stated to be approximately ½ millimeter. In the present invention the diameter of the individual element is between 2 and 20 millimeters, which is translated into English measurement between 0.08" and 0.8". The passageways through the hollow elements are meaningfully described as capillary because it is the intent that these passageways be rather small because their smallness serves a specific function, namely, retention of water therein until it is desired to give up the water.

A third object of the invention is to provide two types of spaces involved in the mass of elements under consideration. One type of space is the capillary passages as above discussed. These are of tiny diameter. The other kind of space is the space between elements which is not necessarily of capillary dimension. It is larger. So, there is in the present mass of hollow elements a "mix" of these two kinds of differently dimensioned spaces, one tiny so as to exert capillary action, and the other larger so as not to exert an action of a capillary nature. One tends to hold water, these being the capillary passages, and the other tends to permit the flow of water therethrough. As a whole, the mass of elements does not encourage flow of water therethrough. Water only can flow with some degree of freedom through the spaces between the elements, but it cannot flow through the elements due to the capillary dimensions of the passages defined by the elements.

The various objects of the invention are achieved in that a mass of hollow elements of various sizes, shapes, wall thicknesses and rigidity, said hollow elements internally defining through open-ended capillary or semi-capillary passages, are dispersed in soil in mutual contact and so oriented relative to one another as to provide between adjacent hollow elements spaces of various shapes and dimensions which combine with the capillary or semi-capillary passages of the hollow elements to form a porous mass for drainage, irrigation or lightening of soil. These are the "spaces" to which reference has been made immediately above, which are to be contrasted with the "capillary" open-ended passage extending through each of the sundry hollow elements.

In fact, the invention does not constitute merely a large number of hollow elements each having a capillary or semi-capillary through open-ended passage and each having adjacent hollow elements. More is involved, namely, this plurality of hollow elements are "dispersed in the soil".

Actually, the invention resides in the combination of the soil and the large group of hollow elements, which latter are specifically defined and which jointly make up the invention. The hollow elements alone do not constitute the invention, nor does the soil (dirt) alone make up the invention. It is the combination of the two with the elements dispersed through the soil. Therefore, the invention resides in the formation of a mixture of soil and a large number of hollow elements, with the hollow elements being of different sizes, shapes, wall thicknesses and rigidity, with the hollow elements defining spaces between them, and with the hollow elements defining through open-ended passageways through the elements themselves as distinct from the spaces between the elements. All of this permits two different kinds of retention and flow of water through the soil-plurality of elements mix. One is a rather easy flow, this being through the spaces, and the other having a tendency to retain the water, this being the capillary and semi-capillary passages.

U.S. Pat. No. 3,233,414 to Hansen et al. has been cited in the corresponding application Ser. No. 169,711. Admittedly, Hansen et al. do not have any dimensions given for their tile elements, but it is not too difficult to arrive at an approximation of the sizes of the elements. The elements are shown as being in a trench. The trench has a width and a depth. It would seem to require no particular argument to convince anyone in this art that the trench is more than small; that is to say, it would be ridiculous to assume that the trench is a few inches deep and less than a few inches wide. Likewise, the trench cannot be unduly deep nor unduly wide. A reasonable guess, i.e. an intelligent guess, is that the trench is about 5 ft. deep and 4 ft. wide. This would be typical of a hand or machine-dug trench which has no particular cause to be unduly deep or unduly wide. Let it be assumed, then, that the width and depth of the trench are of the dimensions indicated. If one counts the number of elements across the width, the elements would be about 6" long and 6" in diameter; similarly for the depth. That means that the passages in the elements are about 6". This is consistent with the mode of operation described for the Hansen et al. drain field tile in which the elements are supposed to permit ready traversal of water therethrough as indicated by the arrows in FIG. 5. Notice that the path of the arrows extends right through the openings in the passages, indicating that the water flows through the passages of the elements. This is directly contrary to the various objects of the present invention as shown above, particularly since each of the hollow elements of applicants has a passageway of capillary or semi-capillary dimensions and it is the purpose of this passageway to combine with the spaces between abutting hollow elements to provide a mix of passageways to differently control the flow of water. Indeed, there is no flow of water through the capillary passages. Therein lies the basic distinction between the Hansen et al. drain field tile and applicants' combined soil and multiplicity of hollow elements.

Other and further objects and advantages of the invention will become more evident from a consideration of the following specification when read in conjunction with the amended drawings, in which.

Figure 1:
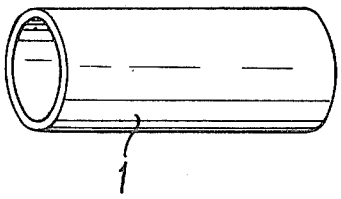
FIG. 1 is a perspective view of a hollow element used for making the draining or irrigation mass of the invention.

Referring now more particularly to the drawings, FIG. 1 shows a hollow element 1 the length of which can vary within relatively large proportions as to its diameter. However, a length/diameter between 1 and 2, and 1 and 10, appears as particularly appropriate, the diameter being preferably between 2 and 20 mm. The wall thickness of the hollow body 1 may also vary rather widely so that some hollow elements may be more rigid than others.

Figure 2:
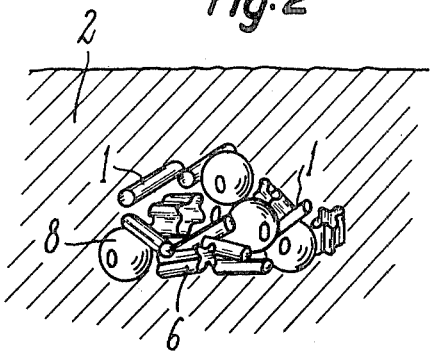
FIG. 2 is a schematic cross-sectional view illustrating a draining mass formed in trenches.

For forming a draining mass, one digs in the ground a trench 2, such as the trench shown in FIG. 2, and the hollow elements are bulked up in said trench. It is advantageous that said hollow elements exhibit different characteristics as regards their length and diameter so that they intermingle and get more or less deformed.

For forming the draining mass, it is further advantageous that the hollow elements are not all of the same shape, or that their shape is adapted as a function of the particular results to obtain.

Figure 3:
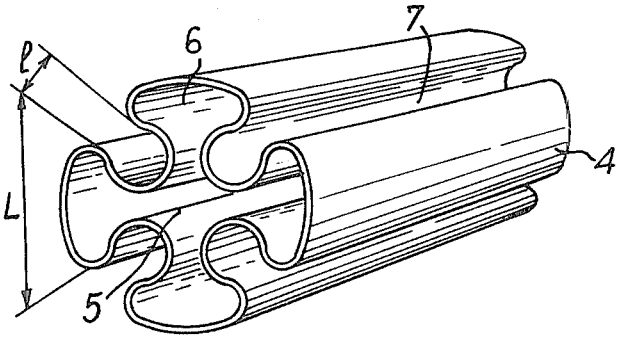
FIGS. 3–5 are perspective views of other embodiments of the hollow elements used for forming the draining or irrigation mass of the invention.

FIG. 3 is an illustration of a first alternative embodiment of a tubular hollow element 4 defining a median duct 5 and peripheral ducts 6 separated from each other by spaces 7.

In cross-section, the peripheral ducts 6 are substantially in the shape of the letter Ω so that the opening of the spaces 7 presents a width 1 notably smaller than the width L of said Ω-shaped ducts.

In this manner, the hollow elements of FIG. 3 have walls of great softness until the edges of the two Ω-shaped ducts come into engagement, thereby stiffening the element which is not completely crushed. Moreover, the opening of the spaces 7 results in that two elements cannot mutually interpenetrate, one being thereby ensured of a good drainage or of a good irrigation.

Figure 4:
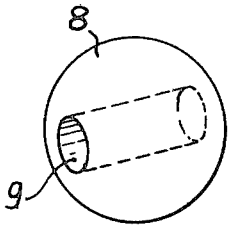

In FIG. 4, the hollow elements 8 are spherical-shaped, or approximately spherical-shaped bodies, through which are formed one or several ducts 9. Such hollow bodies of small dimension, their diameter being of a few millimeters, constitute small containers retaining water by capillarity in the ducts 9 while forming wedges between the other hollow elements.

Figure 5:
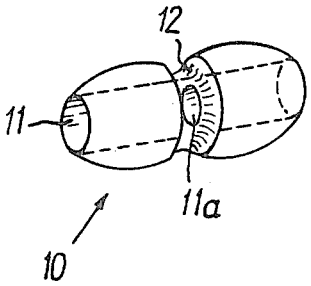

In FIG. 5, the hollow element, designated by numeral 10, is in the form of a diabolo with a longitudinal channel 11, a median groove 12 and a second transverse channel 11*a*; there again, the retention of water is provided by capillarity, within the channels 11 and 11*a* and eventually in the groove 12, while a mass of hollow elements having this shape cannot result into a compact block.

Figure 6:
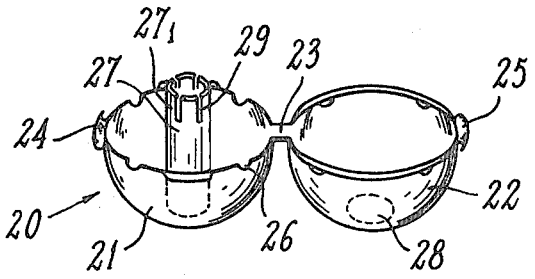
FIG. 6 is a perspective view of a drainage and irrigation element according to the invention, in an open condition.

FIG. 6 illustrates a hollow element 20 made of plastics material, for example by molding, comprising two half-spheres 21, 22, connected by a binding lug 23 acting as a hinge. The half-spheres 21, 22 comprise mutual interlocking means 24, 25 which lock them when they are placed side by side after folding the lug 23.

In the example shown, the interlocking means 24, 25 extend only over part of the periphery of the half-spheres 21, 22 and are respectively a female element and a male element. Said interlocking elements could also be formed by hooks extending over the whole periphery of the two half-spheres.

At least one of the two half-spheres, in the example shown the half-sphere 21, is formed with notches 26 such that, when the two half-spheres are assembled, they define communication holes.

Figure 7:
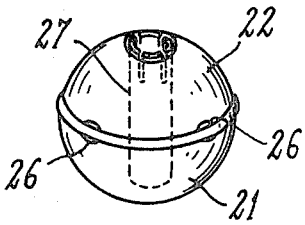
FIG. 7 is a perspective view of the same element, in a closed condition.
Figure 8:
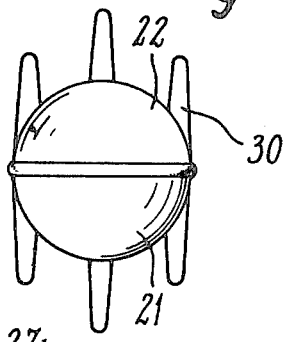
FIG. 8 is a perspective view of an alternative embodiment of the drainage and irrigation element.

One of the half-spheres, in the present case the half-sphere 21, comprise a tube 27 extending from its bottom. The length of tube 27 is at least equal to the diameter of the half-spheres and, preferably, larger, as said tube is adapted for passing through a hole 28 of the other half-sphere when the latter is doubled up as is shown in FIG. 7. The end $27_1$ of the tube 27 is advantageously formed with longitudinal cut-outs 29 which may make the introduction in the hole 28 easier and provides a capillary communication between the inside of tube 27 which is hollow and the inside of the sphere.

In some cases, it is advantageous that the spherical elements have a different diameter of that the tubes 27 are more or less protruding, thereby providing a heterogenous distribution of the elements in the ground in which they are buried.

The spherical hollow elements serve for the retention or the drainage of a certain quantity of water since their inside is hollow and, on the other hand, water may flow through the tube 27 or be retained in it. In the case of the irrigation of a soil and once it has been watered, the spheres are filled as well as the tubes and the water is then redistributed to the ground, but progressively. As a matter of fact, the water can flow first more easily from the inside of the tube, and then, it is the water contained in the spheres which is progressively distributed by passing through the notches 26 and/or eventually the slots 29 and the inside of the tube.

On the other hand, the volumes of earth which separate the various buried spheres have irregular shapes resulting in that the water is also more easily retained in the earth even when the latter contains the spherical elements hereinabove described.

The water retention spherical elements are also efficient for the drainage. When they are buried in a ground which is saturated with water, the water has, in fact, a tendency to fill up the spheres, which favors afterwards the drying of the earth volumes separating said spheres since the earth volumes are no more saturated with water when the spheres are full, and the water contained in the spheres is then progressively returned to the ground as its drying proceeds. On the other hand, if the density of the spheres is large in a ground, the flow of water is favored due to the presence of the tubes 27 forming successive drains.

Figure 9:
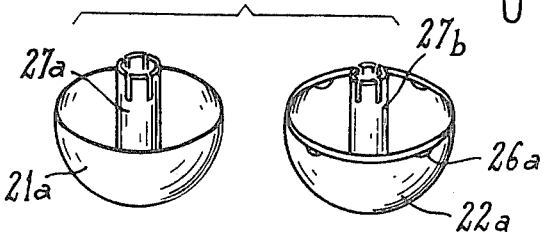
FIG. 9 is an elevational view showing a further development of the invention.

The drainage and irrigation elements in the shape of spheres may be realized in other ways than those just described; for example, and as is shown in FIG. 9, it is possible to mold two half-spheres 21*a*, 22*a*, one of which at least being formed with notches 26*a* on its edge.

According to FIG. 9, each half-sphere comprises a tube segment 27*a*, 27*b*, said segments being adapted for being interlocked into each other. In this way, one may omit the mutual interlocking means 24, 25 described above.

The word "sphere" has been used hereinabove since it well describes the general outer aspect of the drainage and irrigation element. However, if it is desired, one may use elements formed with facets and/or outer protrusions resulting in that two drainage and irrigation elements cannot be joined side by side. This is what is represented in FIG. 9 which shows protrusions 30 formed at various points of the half-spheres 21, 22, said protrusions being advantageously hollow for contributing themselves to the retention of water.

The hollow elements described hereinabove, whatever their shape, are made of plastics material, synthetic or not, and preferably biodegradable, for example paper, cardboard or any other vegetable material, for instance peat. The material used for the formation of the elements is also bonded, if need be, by biodegradable product means, for example vegetable or animal glues. For making the tubes, it is also possible to use mineral materials, for example sand bound by biodegradable glues.

Figure 10:
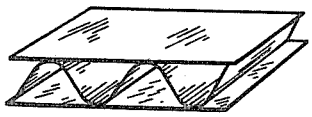
FIG. 10 is a perspective view of particular hollow element.

Another way of making the elements consists, as is shown in FIG. 10, in using corrugated cardboards, eventually salvaged, and in cutting them so that they define hollow elements of variable extension.

A development consists in the impregnation of the materials used for the formation of the elements with various fertilizing products, and particularly fertilizers.

The composition of the elements may vary as a function not only of the nature of the grounds in which the elements have to be buried, but also of the nature of the plantings which are to be made or of the plants already planted. In view of the biodegradable nature of the material forming the elements, or at least the binding material, which provides the cohesiveness of the mineral materials used and which are close to the nature of a natural soil, it appears that the mass of the tubular elements which is buried in the ground destroys itself progressively and the result is a progressive lightening of the ground and the fertilization of the latter when fertilizers are added as supplement.

When the hollow elements are made of kraft cardboard, as in FIG. 10, a fertilizing product solution is preferably incorporated in the cardboard paste, this solution being suspended in a mud which mates with this paste without detrimental effects. The fertilizing product solution may contain nitrogen, phosphoric acid and potash.

The fertilizing product solution will dissolve slowly in the soil before degradation of the cardboard elements while bringing their cellulose part content to the ground after having, during the first months, been used as water retaining means (by capillary effect of the hollow elements) and soil aerating means (by dispersion of the hollow elements within the soil).

Furthermore, since the biodegradability of the cardboard in the soil is caused by a bacterial work and since the bacteria consume nitrogen, it results therefrom an impoverishment of the soil in nitrogen.

This problem has been solved by using elements as shown in FIG. 10. In FIG. 10, the elements 31, 31*a* are formed of plates 32, 32*a* of kraft cardboard and define tubes 33, 33*a* (for example, inner diameter of 5 mm and length of 25 mm). The plates 32, 32*a* are respectively connected with a particular glue having a nitrogen base, for example a formol-urea glue having a degradability which generates nitrogen and restores to the soil its chemical equilibrium.

FIGS. 11–14 illustrate a further development according to which the hollow elements may be indifferently made of a biodegradable material or not.

Figure 11:
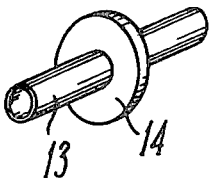
FIGS. 11–14 are perspective view of a alternative embodiments of a further development of the invention.

According to FIG. 11, a hollow tubular element 13, cylindrical or of any other shape, is provided with a flange 14.

Figure 12:
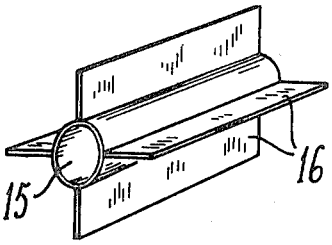

According to FIG. 12, the hollow tubular element 15 is formed with rectilinear or curved wings 16.

Figure 13:
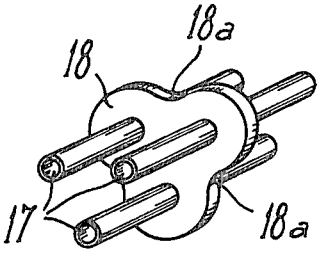

According to FIG. 13, several hollow tubular elements 17 are assembled, at a distance from each other, by a flange 18 which, preferably, is not circular-shaped but defines indentations 18*a* resulting in the formation of baffles even when several elements are joined together.

Figure 14:
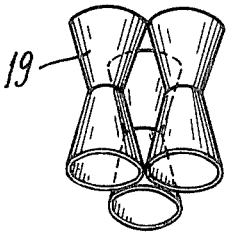

According to FIG. 14, the element comprises several tubes 19, for example three in number, assembled to each other and having each the shape of a diabolo.

It is apparent that all the hereinabove described dispositions have means preventing the hollow elements from being directly joined side by side so that they form a foaming mass of low density which particularly improves the draining or irrigation qualities of the ground in which the hollow elements are buried.

It is often advantageous to use hollow elements of various natures, notably hollow elements the biodegradable binding material of which has a variable lifetime.

It has been found as particularly advantageous, for forming the draining or irrigation mass, to mix the various elements described hereinabove so that their respective qualities add up and make the mass porous and soft. Although this is not shown, it is also possible to mix sand, and even earth, in the mass of hollow elements.

The invention is not limited to the embodiments shown and described in detail, and various modifications may be carried out without departing from its scope.

What is claimed is:

1. A porous mass for drainage of soil which can also be used for irrigation purposes and for lightening of the density of the ground, said mass including hollow elements of various sizes, shapes, wall thicknesses and rigidity, said hollow elements internally defining through open-ended capillary or semi-capillary passages having diameters of between 2 and 20 millimeters, said mass constituting soil in which said hollow elements are dispersed in mutual contact so oriented relative to one another as to provide between adjacent hollow elements spaces of various shapes and dimensions which combine with the capillary or semi-capillary passages of the hollow elements to form a compressible, soft underground litter of great permeability in which water is distributed and redispersed by capillarity, water flowing easily through the spaces between adjacent hollow elements and water tending to be retained in the capillary and semi-capillary passages through the hollow elements.

2. A mass according to claim 1 wherein the hollow elements include elements that have a length between about 2 and 10 times the diameter.

3. A mass according to claim 1 wherein the hollow elements are of a tubular shape that include a central duct and peripheral ducts, the peripheral ducts have an Ω-shaped cross-section, said peripheral ducts being separated by spaces having a width less than the width of the Ω-shaped cross-section.

4. A mass according to claim 1 wherein the hollow elements include elements that have substantially spherical shapes and include at least one through open-ended capillary or semi-capillary passage.

5. A mass according to claim 1 wherein the hollow elements include elements that have substantially a diabolo shape, with at least one through open-ended capillary or semi-capillary passage.

6. A mass according to claim 1 wherein at least some of the hollow elements include external protrusions.

7. A mass according to claim 1 wherein the hollow elements are made from a paper products and corrugated cardboard.

8. A mass according to claim 1 wherein the hollow elements are made from mineral particulate material compatible with soil and bonded by a bio-degradable bonding agent.

9. A mass according to claim 1 wherein the hollow elements are impregnated with fertilizer.

10. A mass according to claim 1 wherein the hollow elements are made of a biogradable material.

11. A mass according to claim 1 wherein some at least of the hollow elements are made of kraft cardboard plates comprising a fertilizing product solution, the plates of each of the elements being connected together with a glue having a nitrogen base.

12. A method for treating soil comprising: dispersing in the soil a plurality of hollow elements of various sizes, shapes, wall thicknesses and rigidity, said hollow elements being so dispersed as to be in mutual contact, said elements internally defining through open-ended capillary or semi-capillary passages having diameters of 2 to 20 millimeters, and being so oriented after dispersal relative to one another as to provide between adjacent hollow element spaces of various shapes and dimensions which combine with the capillary and semi-capillary passages of the hollow elements to form a compressible, soft underground litter of great permeability in which water is distributed and redispersed by capillarity, water flowing easily through the spaces between adjacent hollow elements and water tending to be retained in the capillary and semi-capillary passages through the hollow elements.

* * * * *